US007461749B2

(12) United States Patent
Hanna et al.

(10) Patent No.: US 7,461,749 B2
(45) Date of Patent: Dec. 9, 2008

(54) LOAD-BEARING CHAIR SUPPORT

(75) Inventors: David Matthew Hanna, Galesburg, MI (US); John Douglas Stoner, Caledonia, MI (US)

(73) Assignee: Arvco Container Corporation, Kalamazoo, MI (US)

( * ) Notice: Subject to any disclaimer, the term of this patent is extended or adjusted under 35 U.S.C. 154(b) by 469 days.

(21) Appl. No.: 11/138,731

(22) Filed: May 26, 2005

(65) Prior Publication Data

US 2005/0264080 A1 Dec. 1, 2005

Related U.S. Application Data

(60) Provisional application No. 60/574,819, filed on May 27, 2004.

(51) Int. Cl.
*A47F 7/00* (2006.01)

(52) U.S. Cl. ..... 211/27; 211/73

(58) Field of Classification Search ..... 211/27, 211/72, 73, 70.1, 195; 248/152, 154, 174, 248/300; 297/440.1, 440.12, 440.14, 16, 297/17, 193; 220/62; 206/216
See application file for complete search history.

(56) References Cited

U.S. PATENT DOCUMENTS

| | | | | | |
|---|---|---|---|---|---|
| 1,545,771 | A * | 7/1925 | Hout | 229/107 |
| 1,607,177 | A * | 11/1926 | Stevens | 248/174 |
| 1,656,341 | A * | 1/1928 | Smith | 40/539 |
| 1,902,566 | A * | 3/1933 | Marsh | 211/72 |
| 1,948,902 | A * | 2/1934 | Carmichael | 248/174 |
| 2,043,791 | A * | 6/1936 | Barron | 108/101 |
| 2,106,301 | A * | 1/1938 | Hughes | 211/72 |
| 2,108,096 | A * | 2/1938 | Barsi | 40/539 |
| 2,113,288 | A * | 4/1938 | Berger | 229/107 |
| 2,170,356 | A * | 8/1939 | Stocker | 211/72 |
| 2,290,144 | A * | 7/1942 | Katz | 108/165 |
| 2,361,875 | A * | 10/1944 | Sachs | 108/165 |
| 2,797,815 | A * | 7/1957 | Gorman | 211/72 |
| 4,085,970 | A * | 4/1978 | Klein | 297/440.12 |
| 4,530,548 | A * | 7/1985 | Spamer et al. | 312/45 |
| 4,605,130 | A * | 8/1986 | Taub | 211/59.2 |
| 4,648,658 | A * | 3/1987 | Calco | 297/440.12 |
| 4,784,277 | A * | 11/1988 | Wallish et al. | 211/167 |
| 4,984,848 | A * | 1/1991 | Scalisi et al. | 297/440.12 |
| 5,580,131 | A * | 12/1996 | Ribot | 297/440.12 |
| 7,261,215 | B2 * | 8/2007 | Moss et al. | 211/149 |
| 2005/0264080 | A1 * | 12/2005 | Hanna et al. | 297/440.1 |

OTHER PUBLICATIONS

Hand sketch of protective buns utilized with a pair of stacked chairs, as discussed in Paragraph [0002] of the specification, date unknown (1 page).

Photograph of a foam block chair support, as discussed in Paragraph [0003] of the specification, date unknown (1 page).

* cited by examiner

*Primary Examiner*—Jennifer E. Novosad
(74) *Attorney, Agent, or Firm*—Flynn, Thiel, Boutell & Tanis, P.C.

(57) ABSTRACT

A load-bearing chair support for shipping or transporting objects, such as chairs. The chair support is constructed entirely from a one-piece blank of corrugated material, which is foldable into an upright tubular structure for positioning between a pair of seats of two chairs, with an upper one of the chairs being inverted relative to the opposite lower chair.

21 Claims, 10 Drawing Sheets

LOAD-BEARING CHAIR SUPPORT

CROSS-REFERENCE TO PRIOR APPLICATION

This application claims priority under 35 USC §119(e) of provisional application Ser. No. 60/574 819 filed May 27, 2004, the entire disclosure of which is herein incorporated by reference.

FIELD OF THE INVENTION

This invention relates to an improved support which is assembled from a foldable blank of corrugated material, and designed for supporting two objects, such as a pair of chairs, in vertically stacked relation with one another during shipping.

BACKGROUND OF THE INVENTION

Various types of supports are commercially employed for the shipment of goods, such as chairs. One type of chair which should be supported during shipping is an office chair. Such office chairs are often shipped with one chair in a lowermost position and an additional chair disposed atop the lower chair and in an inverted orientation relative thereto. Accordingly, supports are typically utilized to stabilize and/or protect the chairs during transport. One such arrangement manufactured by the assignee of the instant invention includes the use of resilient cushions, often called "buns". More specifically, with the two chairs in vertically stacked relation so that the respective chair backs are disposed in horizontally spaced and opposed relation with one another and likewise with the respective chair seats disposed in vertically spaced and opposed relation with one another, a bun is engaged in a nesting fashion over the terminal free end of each chair back, i.e. between each chair back and the seat of the opposed chair. This arrangement, however, results in the transmission of vertical loading forces through the respective chair backs which can result in damage to the chairs during shipping.

Another type of support utilized for shipping office-type chairs is of a foam block-type construction, which foam is relatively rigid and placed between the respective seats of two vertically stacked chairs. While the above block-type support allows the advantageous seat-to-seat support of the respective stacked chairs and avoids undesirable forces on the chair backs encountered with the bun arrangement discussed above, the rigid foam construction of the block-type support is expensive to manufacture, and requires a large amount of space for storage of the supports when not in use and during shipping thereof.

Accordingly, it is an object of the instant invention to provide an improved chair support for supporting a pair of chairs, such as office-type chairs, in vertically stacked relation with one another in a seat-to-seat and back-to-back orientation as discussed above, wherein the support is constructed entirely from a one-piece, monolithic blank of corrugated material, such as cardboard. The blank can thus be shipped and stored in a flat configuration which greatly reduces shipping and storage space, and is much less costly to manufacture.

Other objects and purposes of the invention will be apparent to persons familiar with arrangements of this general type upon reading the following specification and inspecting the accompanying drawings.

Figure 1:
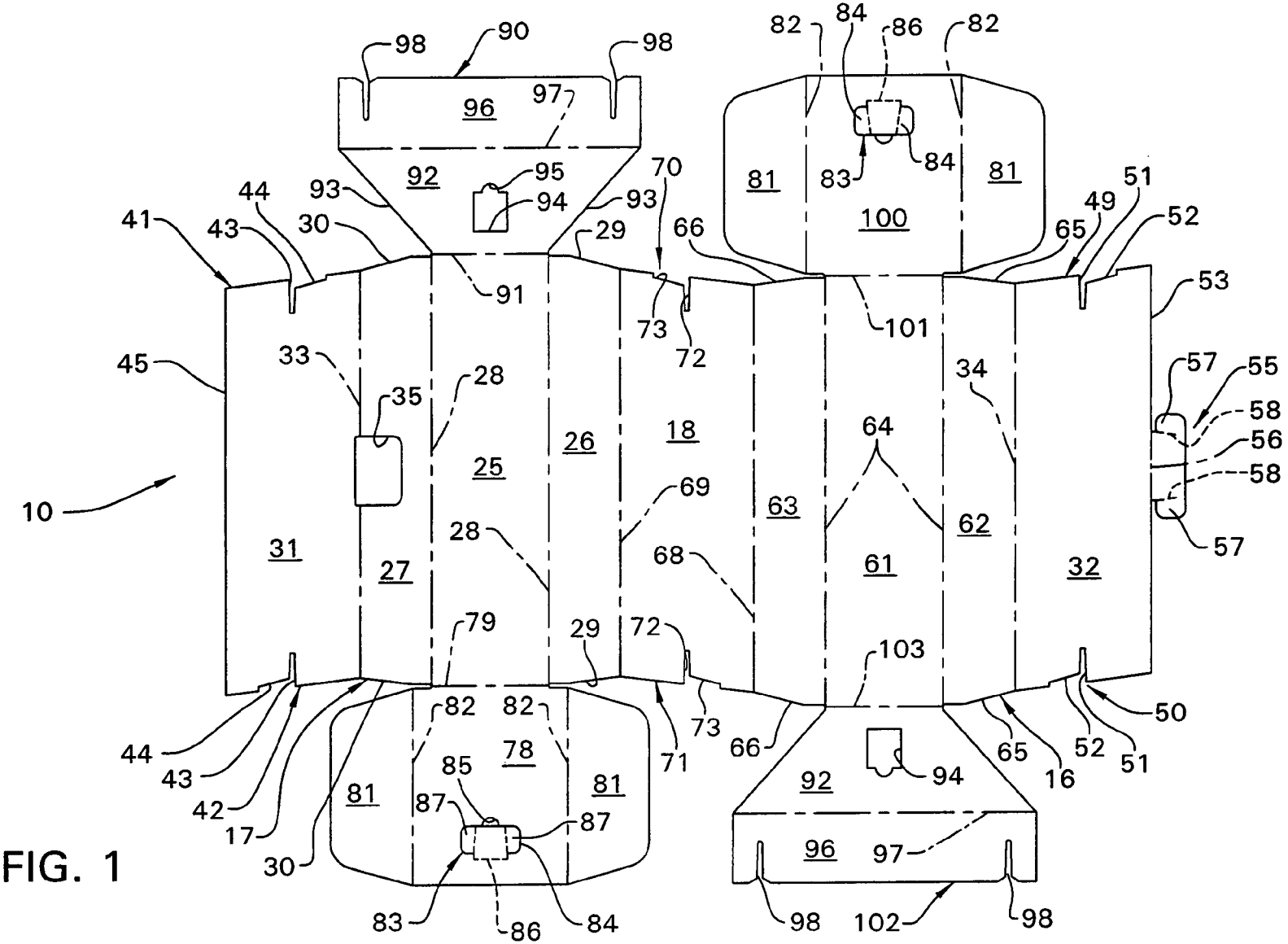
FIG. 1 is a plan view of an unfolded flat, one-piece blank used for preparing the chair support according to the present invention.
Figure 2:
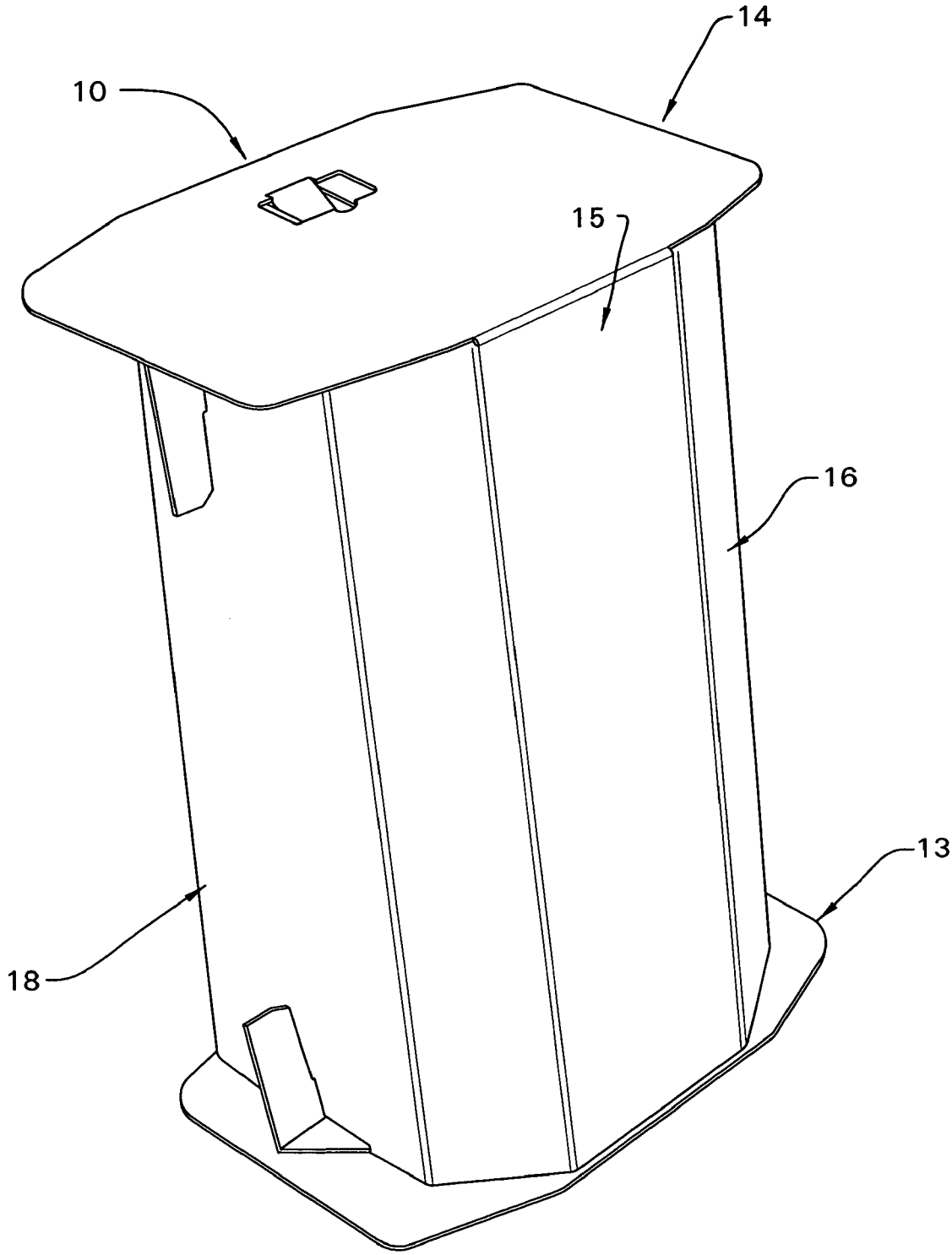
FIG. 2 is a front perspective view of the support in an assembled configuration.
Figure 3:
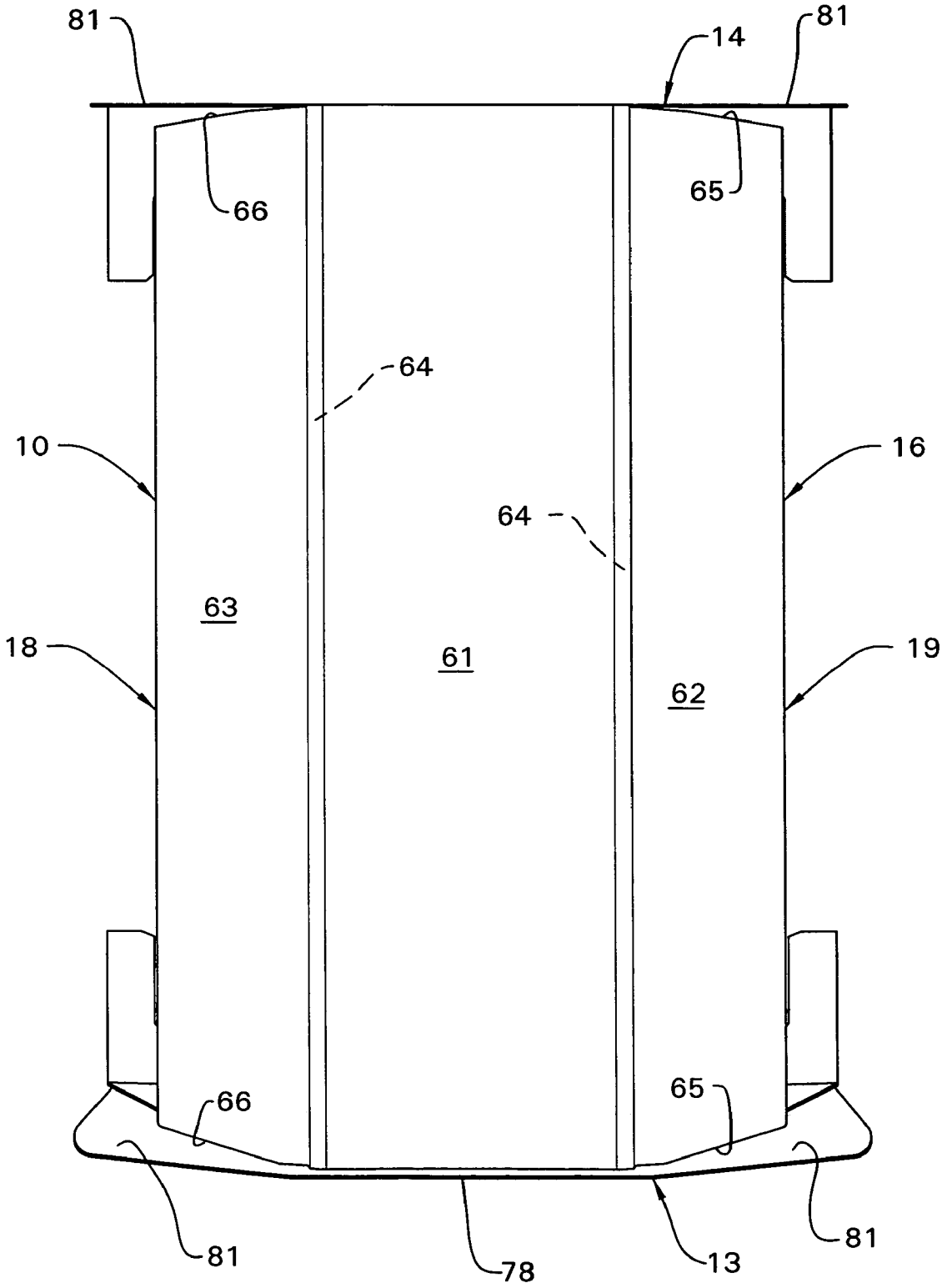
FIG. 3 is an elevational front view of the support in an assembled configuration.
Figure 4:
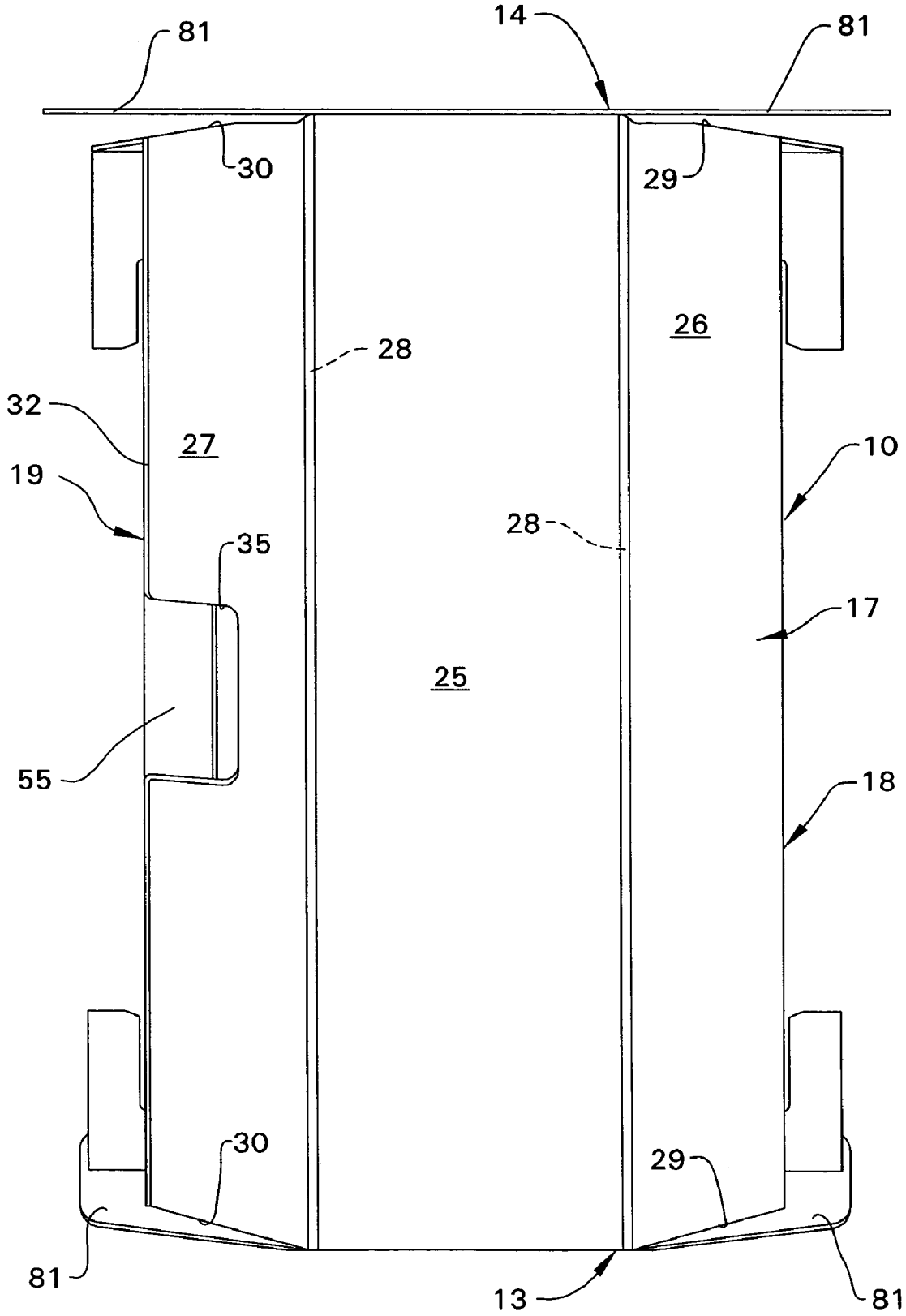
FIG. 4 is an elevational rear view of the support in an assembled configuration.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center A of the support and designated parts thereof. Said terminology will include the words specifically mentioned, derivatives thereof, and words of similar import.

DETAILED DESCRIPTION

Referring to FIG. 1, the present invention is directed to a flat blank 10 which in the illustrated embodiment is constructed of stiff, double-faced corrugated material, such as cardboard having a corrugated interior layer bonded between a pair of flat facing layers, which layers in the illustrated embodiment are all of rather thin paper or fiberboard. The blank 10 is prepared using techniques which are conventional and well known in the box forming industry. It will be appreciated that the blank 10 may, in some embodiments be constructed of corrugated plastic.

Figure 9:
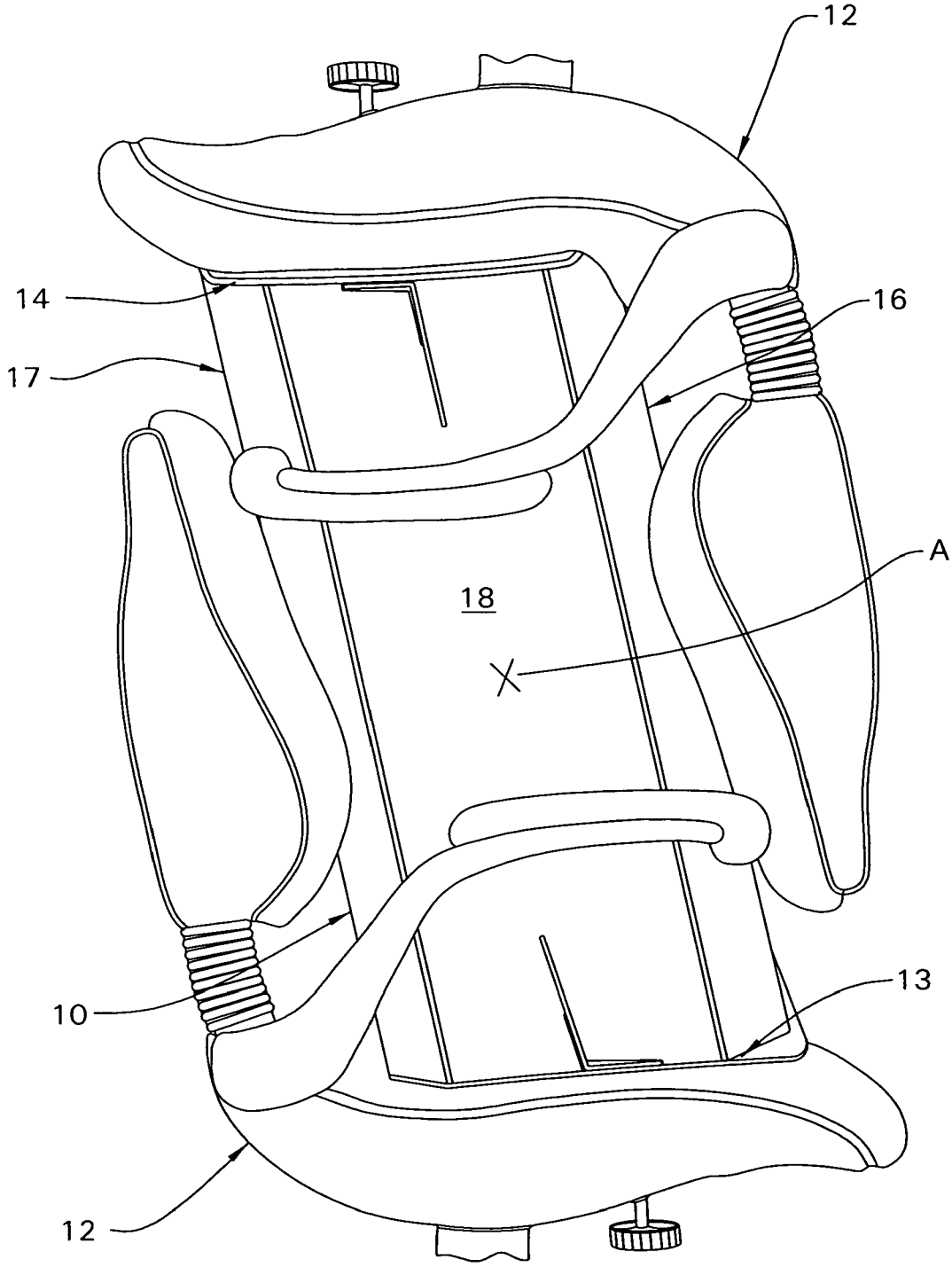
FIG. 9 is an elevational side view of the support nested between a pair of vertically stacked chairs.
Figure 10:
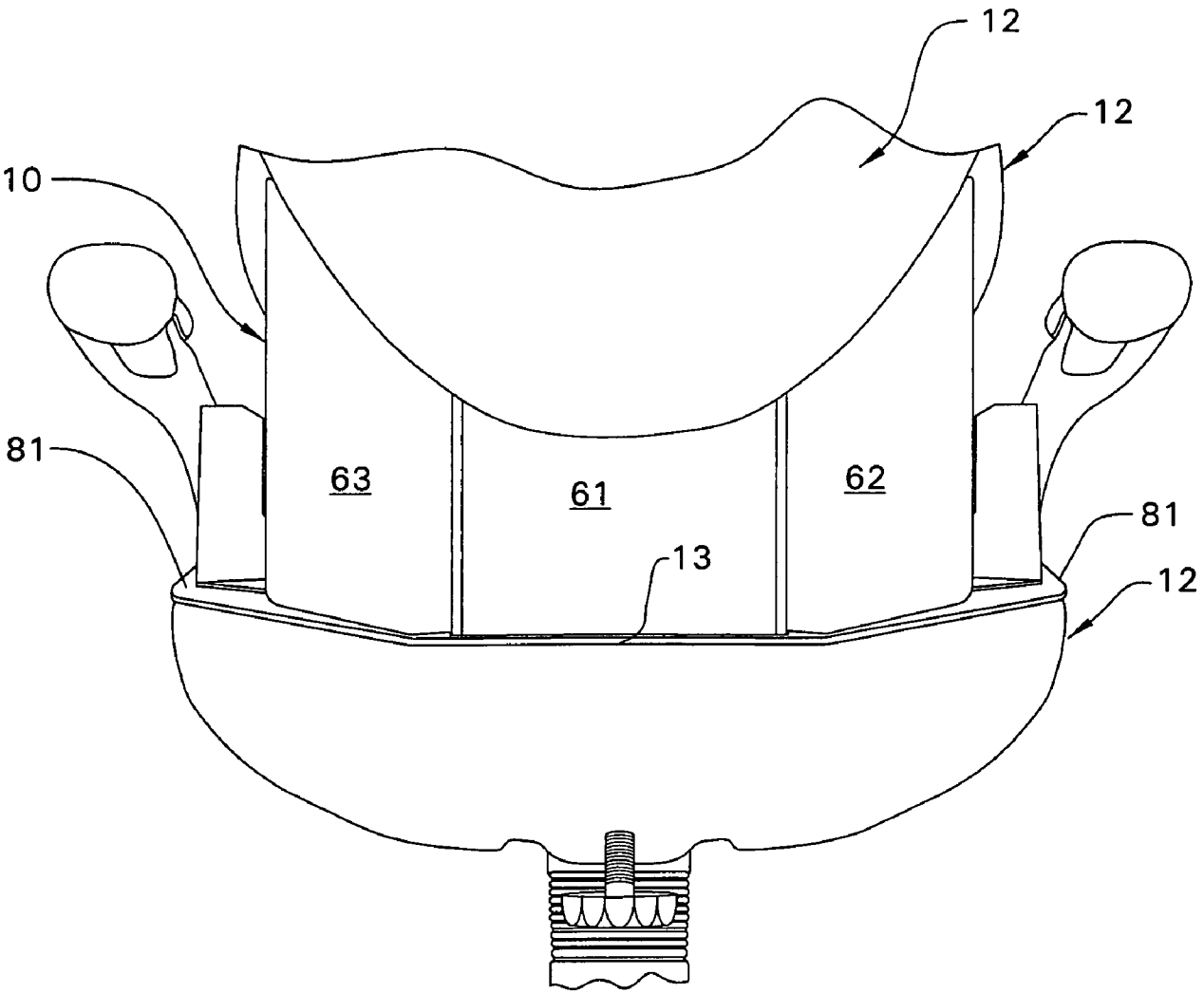
FIG. 10 is an elevational front view of the support nested between two chairs similar to FIG. 8.

The blank 10 is foldable into the shape of a load-bearing support 11. The support 11 is suitable for stabilizing and supporting a pair of chairs 12 during shipping or transport thereof, as shown in FIGS. 9 and 10. The load-bearing chair support 11 includes a bottom part or base 13 and a top part 14 which are joined to one another by a generally tubular sidewall structure 15. Tubular sidewall 15 is defined by a front wall 16 and a rear wall 17 disposed in opposed relation with the front wall 16, and a pair of opposed end walls 18 and 19 which interconnect the respective front and rear walls 16 and 17.

Referring to FIG. 1, the blank 10 is a flat and generally planar, monolithic, one-piece element. Rear wall 17 of this blank 10 is of a three-part construction, defined by a centrally oriented and generally rectangular part 25 bordered on opposite sides thereof by respective outer parts 26 and 27 which are joined to central part 25 through respective parallel fold lines 28. Outer part 26 defines a pair of edges 29 which project inwardly and away from the respective fold line 28. Likewise, outer part 27 defines a pair of edges 30 which project inwardly and away from the respective fold line 28.

In the illustrated embodiment, end wall 19 is of a two-part structure defined by first and second end flaps 31 and 32. First end flap 31 is joined through a fold line 33 to outer part 27 of rear wall 17, and second end flap 32 is joined to front wall 16 through a fold line 34. Outer part 27 of rear wall 17 defines therein an end wall, locking flap-receiving opening 35 which is generally rectangular and disposed substantially centrally within outer part 27. It will be appreciated that end wall 19 may instead be constructed of a single flap joined to one of front and rear walls 16 and 17.

First end flap 31 includes a pair of edges 41 and 42 which angle downwardly from the fold line 33. Each of the edges 41 and 42 define therein a receiving slot 43 which projects inwardly into first end flap 31 and is disposed immediately adjacent a shallow recess or notch 44 defined in the respective edge 41 and 42. First end flap 31 also defines an outer terminal edge 45 which is generally parallel with fold line 33 and extends between the respective edges 41 and 42. Second end flap 32, which is joined to front wall 16, includes a pair of edges 49 and 50 which angle upwardly from the respective fold line 34. Each edge 49 and 50 defines therein a tab receiving slot 51 which projects inwardly into second end flap 32 and is disposed immediately adjacent a shallow notch 52. Second end flap 32 also defines an outer terminal edge 53 which interconnects the respective edges 49 and 50 and is generally parallel to fold line 34. A locking flap 55 is joined to second end flap 32 through a fold line 56 parallel to and spaced outwardly from fold line 34. Locking flap 55 defines thereon a pair of smaller side flaps 57 which are foldable inwardly about respective fold lines 58 transverse to fold line 56.

Front wall 16, like rear wall 17, is of a three-part construction defined by a central rectangular part 61, and respective outer parts 62 and 63 which are joined to central part 61 through respective fold lines 64. Outer part 62 includes a pair of edges 65 which respectively angle inwardly in a direction away from the respective fold line 64. Outer part 63 defines a pair of edges 66 which project inwardly and away from the respective fold line 64.

End wall 18 is of a one-piece construction and is joined to outer part 63 of front wall 16 through a fold line 68, and is joined to outer part 26 of rear wall 17 through a fold line 69 which is parallel to fold line 68. Fold lines 68 and 69 are in turn parallel to fold lines 28 and 64. End wall 18 defines a pair of edges 70 and 71 which angle downwardly from fold line 69. Each edge 70 and 71 includes a tab receiving slot 72 therein which extends into end wall 18 and is disposed immediately adjacent a shallow recess or notch 73 defined in end wall 18.

Bottom part or base 13 includes a bottom flap 78 which is generally rectangular and is joined to central part 25 of rear wall 17 through a fold line 79. Bottom flap 78 includes a pair of side flaps 81 which are joined to bottom flap 78 through respective parallel fold lines 82. Bottom flap 78 additionally includes a lock flap 83 which is defined by a cut line 84 disposed within flap 78. Cut line 84 defines a semi-circular recess or finger hole 85 therein. Lock flap 83 defines therein a generally U-shaped fold line 86, which permits the formation of respective side flaps 87 and allows the lock flap 83 to be folded upwardly and into the interior of the chair support 11 as discussed further below.

A locking flap 90 is joined to central part 25 of rear wall 17 through a fold line 91 which is parallel to fold line 79. Locking flap 90 includes a generally truncated triangle-shaped part 92 having a pair of edges 93 which angle outwardly from fold line 91. Part 92 additionally defines therein a cutout or opening 94 defining a semi-circular recess or finger hole 95. Locking flap 90 also includes an outer lock part 96 which is joined to part 92 through a fold line 97 parallel to and spaced outwardly from fold line 91. Outer lock part 96 defines therein a pair of slots 98 which are spaced laterally from one another and project inwardly along a substantial portion of lock part 96 towards fold line 97.

Top part 14 includes a top flap 100 which is joined to central part 61 of front wall 16 through a fold line 101. Top flap 100 is identical to bottom flap 78 discussed above with respect to base 13, and therefore the same reference numbers are utilized for top flap 100 as are utilized with bottom flap 78. A locking flap 102 is joined to central part 61 of front wall 16 through a fold line 103 which is parallel to and spaced from fold line 101. Locking flap 102 is identical to locking flap 90, and accordingly includes the same reference numbers as used relative to locking flap 90.

The blank 10 will normally be maintained in the flat condition illustrated by FIG. 1, which facilitates compact shipping and storage thereof. The blank 10 may be stamped or die-cut from a large sheet of corrugated cardboard so as to result in the formation of a one-piece blank as illustrated by FIG. 1, and minor assembly steps are then required to form the load-bearing chair support 11. These assembly steps will now be briefly described to ensure a complete understanding of the invention.

Starting with the blank 10 in the flat condition shown in FIG. 1, the front wall 16, rear wall 17 and end walls 18 and 19 are all folded inwardly towards one another about the respective fold lines 28, 33, 34, 64, 68 and 69 so as to form the generally tubular side wall structure 15 with second end flap 32 of end wall 19 disposed in outer superimposed relation with first end flap 31 of end wall 19. The tubular wall structure 15 is then maintained in this position and locking flap 55 of second end flap 32 is inserted into opening 35 of outer part 27 of rear wall 17. More specifically, locking flap 55 is folded by exerting an inwardly directed force on each of the smaller flaps 57 so that same fold inwardly about their respective fold lines 58 and the entire locking flap 55 (including smaller flaps 57) is then pushed inwardly into the interior of the tubular sidewall structure 15. Once locking flap 55 clears the edge of opening 35, the respective flaps 57 will spring a short distance back outwardly towards the inner surface of outer part 27 of rear wall 17 so as to retain the locking flap 55 within opening 35 to hold the respective walls in the tubular configuration.

Figure 7:
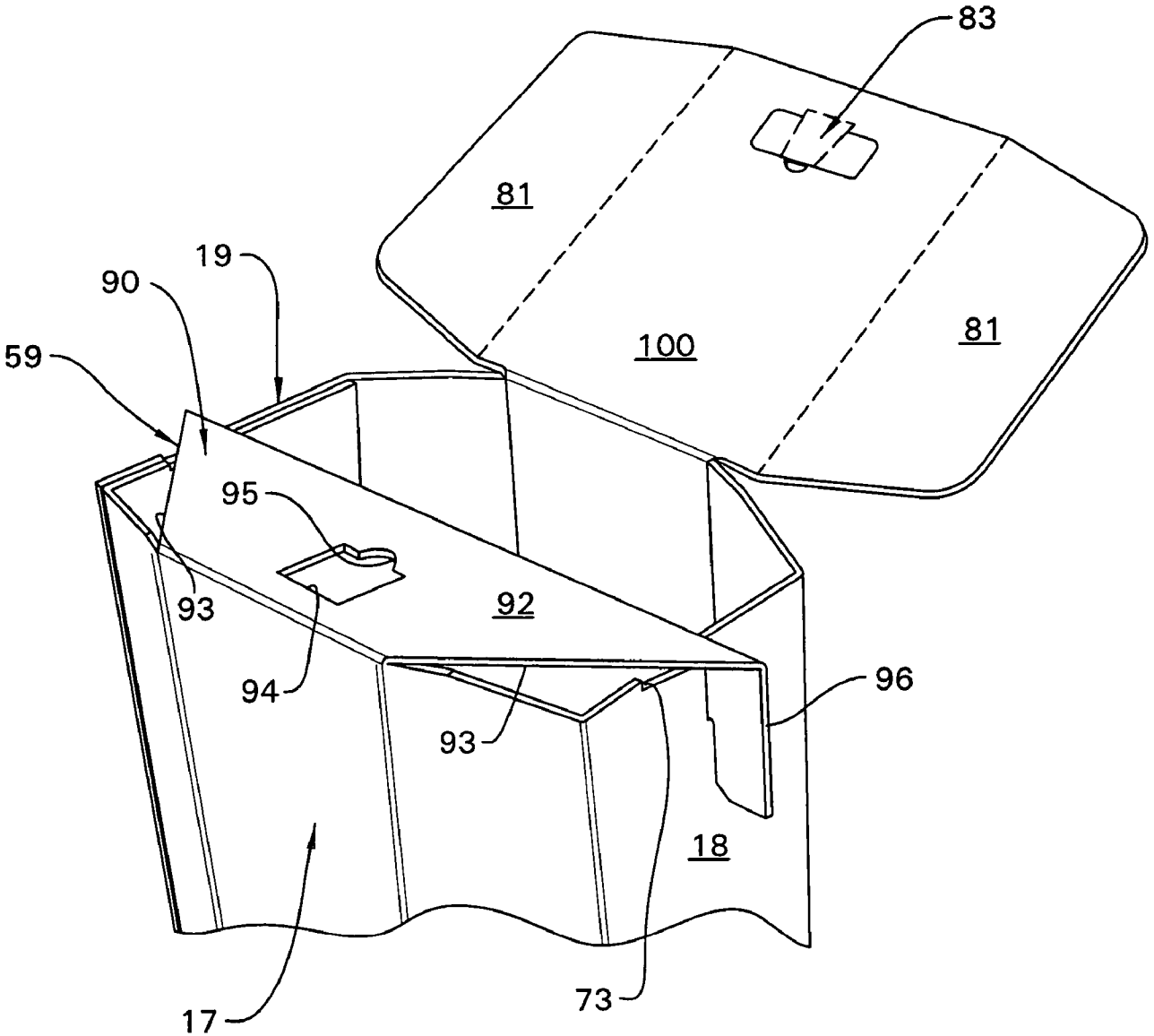
FIG. 7 is a perspective view similar to FIG. 6 with the locking flap in a locked position relative to the tubular side wall.
Figure 8:
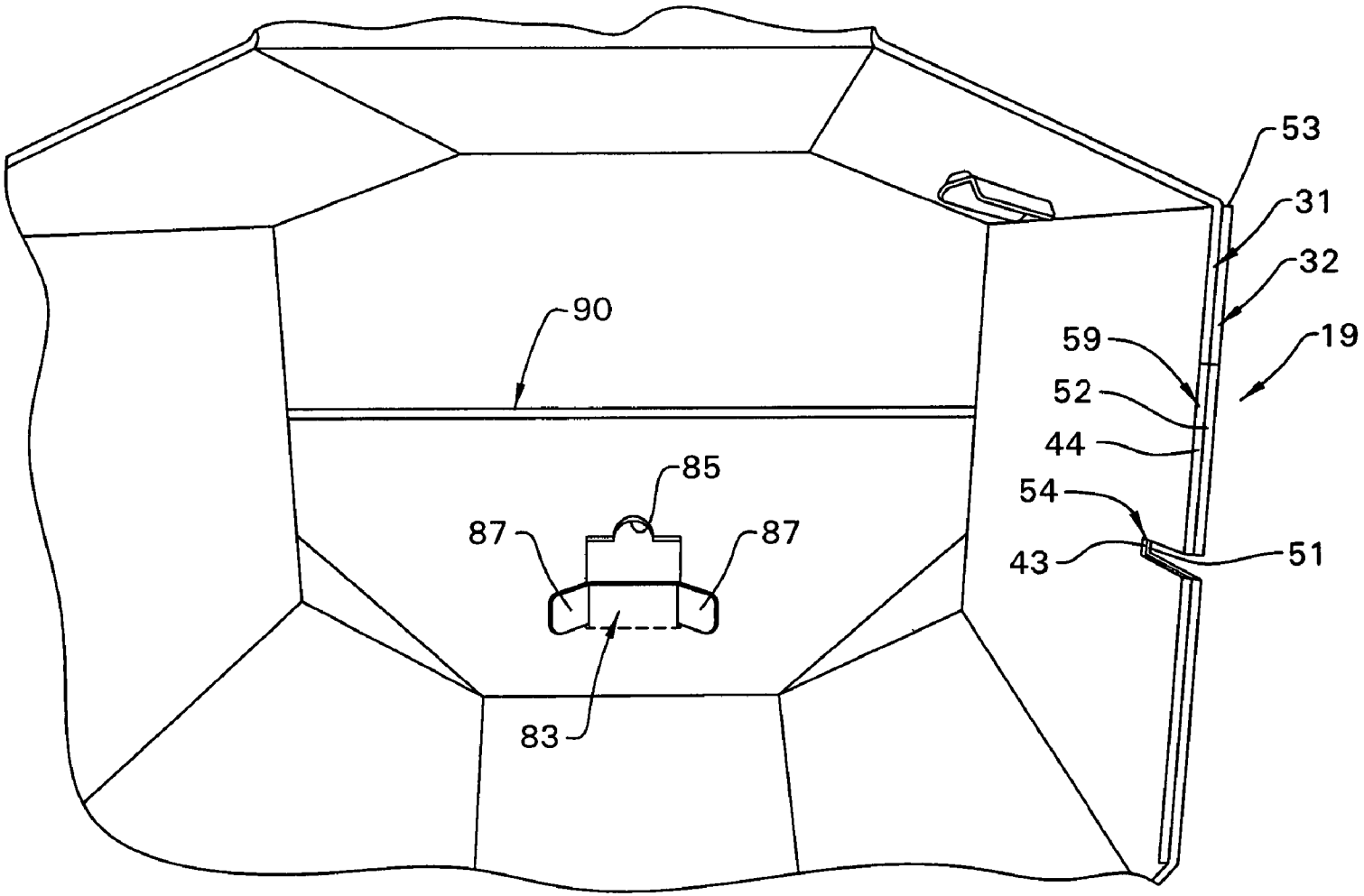
FIG. 8 is a top view of the interior of the support, prior to assembly of the locking flap and top flap at one end of the support.

With the respective walls in the tubular configuration as discussed above, locking flap 90 is folded inwardly towards the tubular wall 15 about the fold line 91. As the locking flap 90 is folded inwardly, the lock part 96 is also folded inwardly about the fold line 97. In this regard, with the walls in a tubular configuration with second end flap 32 superimposed over first end flap 31, the respective slots 43 of first end flap 31 align with the respective slots 51 of second end flap 32 so as to define a single slot 54 (FIG. 8) at each of the upper and lower ends of end wall 19. Likewise, the notches 44 of first end flap 31 align with the respective notches 52 of second end flap 32 when the walls are in the tubular configuration so as to define a single shallow notch 59 at each of the upper and lower ends of end wall 19. As the outer lock part 96 is folded inwardly about the respective fold line 97, the slots 98 thereof are aligned with slots 54 and 72 of the respective end walls 19 and 18, and pressure is applied inwardly to the outer surface of the part 92 of locking flap 90 so that the outer lock part 96 is pushed into the interior of the tubular wall structure 15 and the slots 98 bottom out in the respective slots 54 and 72. As shown in FIG. 7, the shallow notches 59 and 73 at one end of end walls 19 and 18, respectively, receive portions of the lock part 92 therein when lock part 96 is completely seated within slots 54 and 72, so that lock part 96 is substantially flush with the upper edges of the tubular side wall 15. The top flap 100 is then folded inwardly towards the tubular wall about the respective fold line 101 until the top flap 100 is superimposed on the outer surface of part 92 of locking flap 90. With the top flap 100 in this position, the lock flap 83 is inserted into the corresponding opening 94 located in the part 92 of locking flap 90. More specifically, the locking flap 83 is folded inwardly about its respective fold line 86 while folding flaps 87 inwardly about fold line 86 to allow insertion of lock flap 83 into opening 94. With lock flap 83 disposed within opening 94, the respective flaps 87 will then spring towards the inner surface of the respective part 92 and retain the locking flap 83 within the opening 94. The finger holes 85 and 95 formed in the top flap 100 and lock part 92 allow the flaps 83 to be pulled outwardly from opening 94 to allow disassembly of the support 11. The bottom flap 78 and locking flap 102 at the opposite end of tubular wall structure 15 are assembled together in a similar manner as locking flap 90 and top flap 100 to close off the opposite end of structure 15, and may be assembled prior to flaps 90 and 100 so that the tubular wall 15 can be positioned in an upright position.

It will be appreciated that the above assembly steps are only one example of an assembly procedure for support 11, and other procedures may be utilized.

Figure 5:
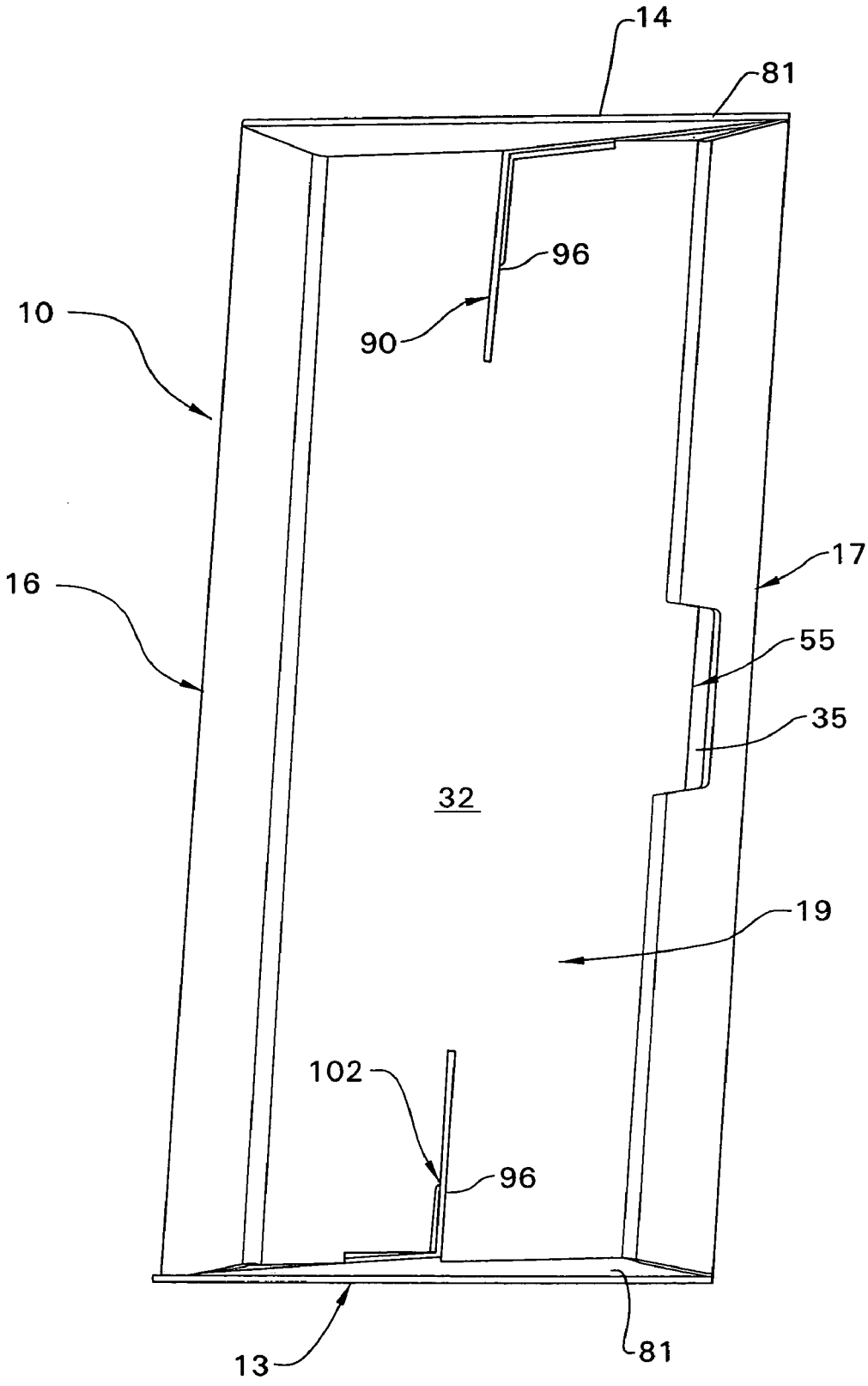
FIG. 5 is an elevational side view of the assembled support.
Figure 6:
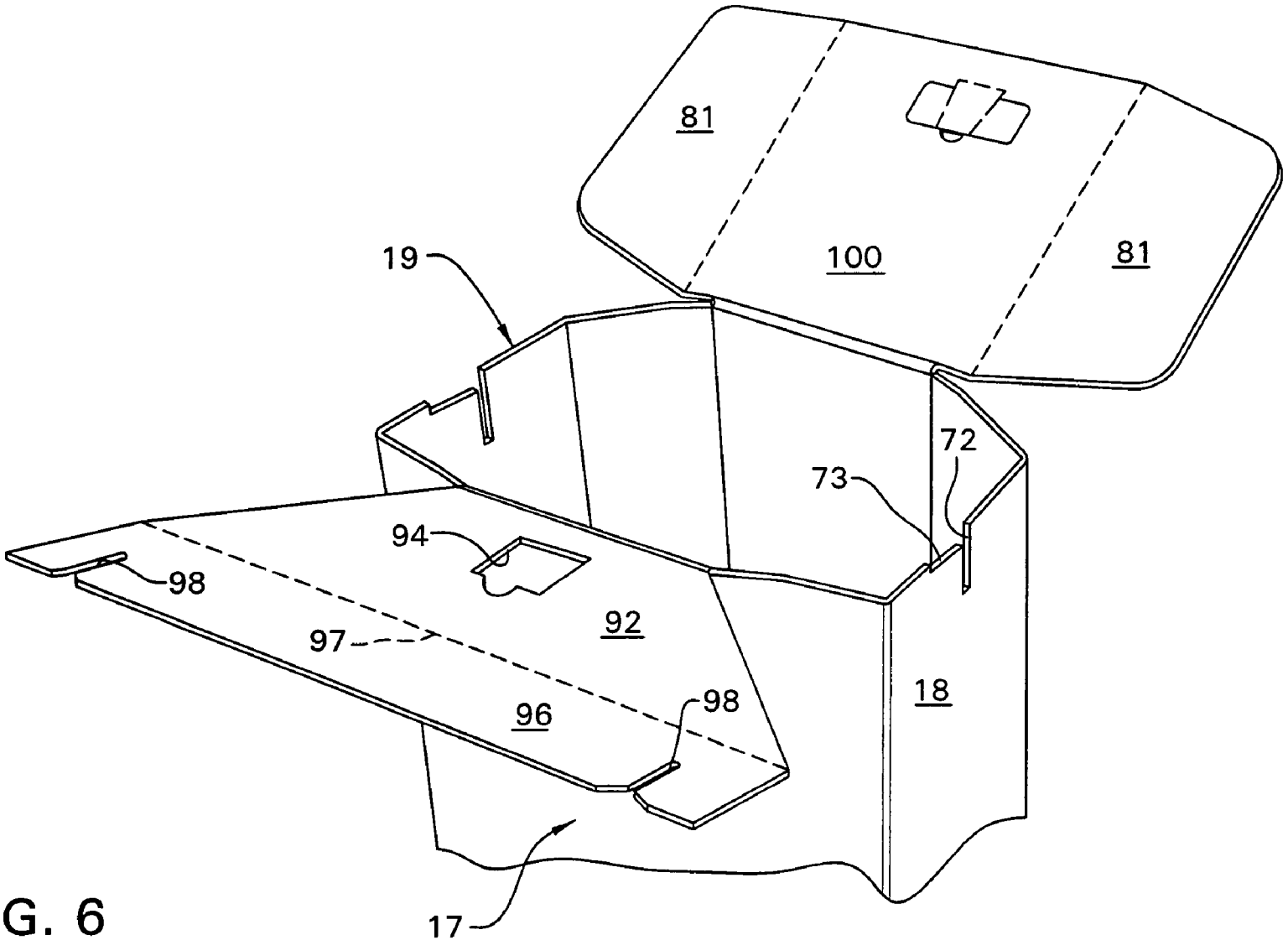
FIG. 6 is a perspective view of one end of the support in a partially assembled configuration.

After assembly of the blank 10 as discussed above, the chair support 11 is oriented at a slight angle relative to the vertical, and in one embodiment this angle has a value of approximately ten degrees (FIG. 5), and may be in the range of 5-15 degrees. As shown in FIGS. 9 and 10, the angled orientation of the chair support 11 allows the support 11 to be snugly nested between two chairs 12, wherein the rear wall 17 is disposed in opposed and facing relation with the back of the bottom chair 12 and generally follows the slight rearward inclination of the back of a typical chair. The upper chair 12 is then inverted relative to the lower chair 12, and its back disposed in opposed and facing relation with the front wall 16 of support 11 so that the seat of the upper chair 12 rests upon top part 14. The inwardly angled orientation of the respective outer parts 26 and 27 of rear wall 17, and likewise the inwardly angled orientation of the respective outer parts 62 and 63 of front wall 16, allow the respective front and rear walls 16 and 17 to generally conform to the shallow arcuate configuration of a typical chair back of an office-type chair. Further, the upper and lower angled edges 29 and 30 of rear wall 17, and the upper and lower angled edges 65 and 66 of front wall 16, permit inward deflection of the respective side flaps 81 of top and bottom flaps 100 and 78 towards the respective adjacent parts 92 of locking flaps 90 and 102, which allows the upper and lower ends of the chair support 11 to nest within the shallow arcuate configuration of the respective seats of the chairs 12, as shown in FIG. 10.

The fold lines 79 and 91 which define outer transverse edges of rear wall 17 are parallel to, non-colinear with, and offset from the respective fold lines 101 and 103 which define the outer transverse edges of front wall 16. In FIG. 1, the edges 79 and 91 are both offset by the same amount and in the same direction parallel to the plane of the blank 10 from the respective edges 101 and 103. This configuration, along with the angled transverse edges of the end walls 18 and 19 as discussed above, allows the support 11 to assume an angled orientation relative to the vertical.

With the chair support 11 positioned between the opposed top and bottom chairs 12, the stacked chair arrangement including support 11 is then typically completely enclosed within a protective cover or bag and bound tightly with straps. Chairs 12 can thus be shipped in a relatively compact formation in a seat-to-seat arrangement, which avoids applying unwanted force to the backs of the chairs 12 as was the case with the above-discussed bun arrangement. Further, by constructing the chair support 11 from a foldable blank of corrugated material, such as cardboard, the chair support 11 according to the invention is a much less costly alternative to the above-discussed foam block support. Further, the chair support 11 is also advantageous in comparison to the foam block support with respect to space requirements for storing the supports 11, since same can be stored in flat-blank form until same are to be used.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A load-bearing support for transporting chairs, said support being formed entirely from a one-piece blank, said support including a generally tubular sidewall defining a hollow interior, a base and a top part disposed in spaced relation from one another at respective opposite ends of said tubular sidewall, said tubular sidewall defining a first wall part for being positioned in opposed relation with a chair back of a first chair, and a second wall part spaced from said first wall part for being positioned adjacent a chair back of a second chair disposed in an inverted orientation relative to the first chair, said support having a geometric center located equidistant from said top part and said base and equidistant from said first and second wall parts, said base being configured for positioning atop a seat of the first chair, and said top part being configured for supportive engagement with a seat of the inverted second chair, each of said top part and said base including a central part and a pair of outer side parts disposed on respective opposite sides of said central part, said outer side parts each angling inwardly towards the center of said support as same project away from the respective said central part, said central part of each of said top part and said base being disposed a greater distance from the center of said support than the respective said outer side parts to provide each of said top part and said base with generally outwardly arcuate configurations to conform with respective seats of the second and first chairs having generally inwardly arcuate configurations.

2. The support of claim 1, wherein said support is formed entirely from a one-piece blank of corrugated material.

3. The support of claim 2, wherein said material comprises corrugated cardboard or corrugated plastic.

4. The support of claim 1, wherein said tubular sidewall includes a pair of end wall parts, each said end wall part extending transversely between and interconnecting respective adjacent longitudinal edges of said first and second wall parts.

5. The support of claim 4, wherein one of said end wall parts is defined by a pair of end wall flaps, one of said end wall flaps being disposed in superimposed and overlying relation with the other said end wall flap, said one end wall flap including a locking member thereon which engages with a portion of said tubular sidewall to maintain same in a hollow tubular configuration.

6. The support of claim 1, wherein each said first and second wall part is defined by a generally planar central part and a pair of outer wall parts disposed on respective opposite sides of said central part, said outer wall parts angling inwardly towards the center of said support as same project away from the respective said central part to permit said first and second wall parts to have generally outwardly arcuate configurations to conform to respective chair backs of the first and second chairs having respective generally inwardly arcuate configurations.

7. The support of claim 1, wherein said top part is joined to said first wall part and is oriented transversely relative thereto so as to close off one end of said tubular sidewall, and said base is joined to said second wall part and oriented transversely thereto so as to close off an opposite end of said tubular sidewall.

8. The support of claim 1, further including a first locking flap joined to said second wall part at an opposite edge thereof from said base, said locking flap being oriented transversely relative to said second wall part, said top part being disposed in superimposed, overlying and interlocking relation with said first locking flap, and a second locking flap joined to said first wall part at an opposite edge thereof from said top part, said second locking flap being oriented transversely relative to said first wall part, said base being disposed in superimposed, overlying and interlocking relation with said second locking flap.

9. The support of claim 1, wherein said tubular sidewall when in an upright position projects at an angle relative to the vertical to permit each of said first and second wall parts to conform to a rearward inclination of a chair back.

10. The support of claim 1, wherein said outer side parts of each of said top part and said base are joined to the respective said central part along respective lines of intersection which are generally parallel to one another and which extend transversely between said first and second wall parts of said tubular sidewall.

11. The support of claim 1, wherein said outer side parts and the respective said central part of each of said top part and said base are of a one-piece construction, and said outer side parts are joined to the respective said central part via respective fold lines which are generally parallel to one another and extend transversely between said first and second wall parts of said tubular sidewall.

12. The support of claim 1, wherein said outer side parts and the respective said central part of each of said top part and said base are formed integrally with one another and are joined to said tubular sidewall as flaps, said flap of said top part being joined to an upper edge of one of said first and second wall parts and said flap of said base being joined to a lower edge of one of said first and second wall parts.

13. A load-bearing support for transporting chairs, said support being formed entirely from a one-piece blank, said support including a generally tubular sidewall defining a hollow interior, a base and a top part disposed in spaced relation from one another at respective opposite ends of said tubular sidewall, said tubular sidewall defining a first wall part for being positioned in opposed relation with a chair back of a first chair, and a second wall part spaced from said first wall part for being positioned adjacent a chair back of a second chair disposed in an inverted orientation relative to the first chair, said support having a geometric center located equidistant from said top part and said base and equidistant from said first and second wall parts, said base being configured for positioning atop a seat of the first chair, and said top part being configured for supportive engagement with a seat of the inverted second chair, each said first and second wall part being defined by a central part and a pair of outer wall parts disposed on respective opposite sides of said central part, said outer wall parts angling inwardly towards the center of said support as same project away from the respective said central part, said central part of each of said first and second wall part being disposed a greater distance from the center of said support than the respective said outer wall parts to provide each of said first and second wall parts with generally outwardly arcuate configurations to conform to respective chair backs of the first and second chairs having respective generally inwardly arcuate configurations.

14. The support of claim 13, wherein said support is formed entirely from a one-piece blank of corrugated material.

15. The support of claim 14, wherein said material comprises corrugated cardboard or corrugated plastic.

16. The support of claim 13, wherein said tubular sidewall includes a pair of end wall parts, each said end wall part extending transversely between and interconnecting respective adjacent longitudinal edges of said outer wall parts of said first and second wall parts.

17. The support of claim 16, wherein one of said end wall parts is defined by a pair of end wall flaps, one of said end wall flaps being disposed in superimposed and overlying relation with the other said end wall flap, said one end wall flap including a locking member thereon which engages with a portion of said tubular sidewall to maintain same in a hollow tubular configuration.

18. The support of claim 13, wherein said top part is joined to said first wall part and is oriented transversely relative thereto so as to close off one end of said tubular sidewall, and said base is joined to said second wall part and oriented transversely thereto so as to close off an opposite end of said tubular sidewall.

19. The support of claim 18, wherein each of said top part and said base includes a generally planar central part and a pair of outer side parts disposed on respective opposite sides of said central part, said outer side parts angling inwardly towards the center of said support as same project away from said central part to permit each of said top part and said base to have generally outwardly arcuate configurations which conform to respective seats of the second and first chairs having generally inwardly arcuate configurations.

20. The support of claim 13, wherein said tubular sidewall when in an upright position projects at an angle relative to the vertical to permit each said first and second wall parts to conform to a rearward inclination of a chair back.

21. A load-bearing support for transporting chairs, said support being formed entirely from a one-piece blank, said support including a generally tubular sidewall defining a hollow interior, a base and a top part disposed in spaced relation from one another at respective opposite ends of said tubular sidewall, said tubular sidewall defining a first wall part for being positioned in opposed relation with a chair back of a first chair, and a second wall part spaced from said first wall part for being positioned adjacent a chair back of a second chair disposed in an inverted orientation relative to the first chair, said base being configured for positioning atop a seat of the first chair and said top part being configured for supportive engagement with a seat of the inverted second chair, said support including a first locking flap joined to said second wall part at an opposite edge thereof from said base, said locking flap being oriented transversely relative to said second wall part, said top part being disposed in superimposed, overlying and interlocking relation with said first locking flap, and a second locking flap joined to said first wall part at an opposite edge thereof from said top part, said second locking flap being oriented transversely relative to said first wall part, said base being disposed in superimposed, overlying and interlocking relation with said second locking flap.

* * * * *